US009555340B2

(12) United States Patent
Seder

(10) Patent No.: US 9,555,340 B2
(45) Date of Patent: Jan. 31, 2017

(54) MANUALLY POSABLE FIGURE ANIMATION SYSTEM AND METHOD

(71) Applicant: Rufus Butler Seder, Arlington, MA (US)

(72) Inventor: Rufus Butler Seder, Arlington, MA (US)

( * ) Notice: Subject to any disclaimer, the term of this patent is extended or adjusted under 35 U.S.C. 154(b) by 0 days.

(21) Appl. No.: 14/984,253

(22) Filed: Dec. 30, 2015

(65) Prior Publication Data

US 2016/0184730 A1 Jun. 30, 2016

Related U.S. Application Data

(60) Provisional application No. 62/098,076, filed on Dec. 30, 2014.

(51) Int. Cl.

| | |
|---|---|
| ***A63H 13/20*** | (2006.01) |
| ***A63H 33/22*** | (2006.01) |
| ***A63H 3/04*** | (2006.01) |
| *G09F 19/08* | (2006.01) |

(52) U.S. Cl.

CPC ..... *A63H 33/22* (2013.01); *A63H 3/04* (2013.01)

(58) Field of Classification Search

CPC ..... A63H 7/00; A63H 13/00; A63H 13/20; G09F 10/00; G09F 19/08

USPC ..... 446/236–237, 240, 243; 472/63; 40/414, 40/429

See application file for complete search history.

(56) References Cited

U.S. PATENT DOCUMENTS

| | | | |
|---|---|---|---|
| 29,430 | A | 7/1860 | Ames |
| 1,014,365 | A | 1/1912 | Bourgin |
| 1,804,260 | A | 5/1931 | Kerr |
| 2,350,733 | A | 6/1944 | Drotning |
| D180,372 | S | 5/1957 | Morgan |
| 2,876,570 | A | 3/1959 | Swarbrick |
| 2,959,872 | A | 11/1960 | Rodgers |
| 2,985,057 | A | 5/1961 | Morgan |
| 3,624,691 | A | 11/1971 | Robson et al. |

(Continued)

OTHER PUBLICATIONS

Animation Praxinoscope, www.scientificsonline.com/animation-praxinoscope.html web page, Edmund Scientific's, Tonawanda, NY, USA, May 3, 2011.

(Continued)

*Primary Examiner* — Kien Nguyen

(74) *Attorney, Agent, or Firm* — Thomas P. O'Connell; O'Connell Law Firm

(57) ABSTRACT

An animation system with adjustable support of posable figures. A rotatable platform retains the posable figures along a circumference of a circle through adjustable supports. An animation mechanism, such as a slotted drum or a faceted, mirrored hub, is supported by the platform. The adjustable supports can comprise plastically deformable elongate posts to permit pivoting and longitudinal turning of the figures, adjustment in supported height of the figures, and lateral movement of the figures along the circumference of the circle and radially inward and outward. The elongate posts and the figures can have plastically deformable cores, such as bendable wires, at least partially encased in flexible bodies of material. Each figure can have a torso and a repositionable head and appendages. The elongate posts can have distal ends received by apertures in the platform along the circumference of the circle, proximal ends fixed to the figures, and bendable body portions.

22 Claims, 15 Drawing Sheets

(56) References Cited

U.S. PATENT DOCUMENTS

| | | | | |
|---|---|---|---|---|
| 3,694,062 | A | 9/1972 | Kloenig | |
| 3,700,880 | A | 10/1972 | Smith | |
| 3,745,966 | A | 7/1973 | Seager | |
| 3,951,529 | A | 4/1976 | Gandia | |
| 3,961,434 | A | 6/1976 | Sampon | |
| 4,085,932 | A | 4/1978 | Hamano | |
| 4,186,516 | A * | 2/1980 | Ensmann | A63H 7/00 446/238 |
| 4,307,528 | A | 12/1981 | Dewees et al. | |
| 4,983,890 | A * | 1/1991 | Satoh | A41G 1/002 318/14 |
| 5,412,890 | A * | 5/1995 | Fechter | G09F 19/08 40/414 |
| 5,760,874 | A | 6/1998 | Rudnick | |
| 5,870,170 | A | 2/1999 | Pope | |
| 5,901,484 | A | 5/1999 | Seder | |
| 5,915,853 | A * | 6/1999 | Guilin | G09F 19/08 40/414 |
| 6,097,468 | A | 8/2000 | Muehlenhard | |
| 6,200,189 | B1 * | 3/2001 | Coleman | A23G 3/50 40/414 |
| 6,286,873 | B1 | 9/2001 | Seder | |
| 6,385,875 | B1 | 5/2002 | Santorsola | |
| 6,647,651 | B2 | 11/2003 | Cutright | |
| 6,886,280 | B2 | 5/2005 | Spodek et al. | |
| 6,945,872 | B2 * | 9/2005 | De Vogel | A63H 13/20 40/414 |
| 7,151,541 | B2 | 12/2006 | Seder | |
| 7,331,132 | B1 | 2/2008 | Seder | |
| 7,940,371 | B2 | 5/2011 | Barnett et al. | |
| 2002/0105808 | A1 | 8/2002 | Ting Yup | |
| 2008/0129963 | A1 | 6/2008 | Hohl | |
| 2009/0141241 | A1 | 6/2009 | Buyssens | |

OTHER PUBLICATIONS

Gomorrans Praxinoscope, www.youtube.com, Gomorrans Praxinoscope from 'Giving Birth to Love' LP Side A, 2009, Gomorrans Social Aid & Pleasure Club.

Hasbro, Lite-Brite Spider-Man 3 Flash Art Neon Paint Spinner, www.hasbro.com website, Hasbro, Inc., Pawtucket, Rhode Island, USA.

Sanni-T, Handcrafted zoetrope of a figure skater doing a loop jump, website: www.sanni-t.com/zoetrope, Dec. 21, 2015.

Gary Aden, Lego Zoetrope, 2011 Maker Faire, website: www.youtube.com, Dec. 21, 2015.

Gary Aden, 3D Zoetrope, 2010 California State Fair, website: www.youtube.com, Dec. 21, 2015.

Crayola, LLC, Easton, Pennsylvania, Easy Animation Studio, 2015, website: www.crayola.com, Dec. 22, 2015.

University of the Arts London, London College of Fashion, Undergraduate, 2010, BA (hons), Technical Effects for Performance, Liffey Clement, praxinoscope close up, praxinoscope—BAC exhibition, website: http://showtime.arts.ac.uk/LiffeyClement, Dec. 22, 2015.

Science & Society Picture Library, Zoetrope, 1886, website: http://www.scienceandsociety.co.uk, Dec. 22, 2015.

* cited by examiner

MANUALLY POSABLE FIGURE ANIMATION SYSTEM AND METHOD

FIELD OF THE INVENTION

The present invention relates generally to systems and methods for three-dimensional animation. Stated more particularly, disclosed herein are a system for producing three-dimensional animation and a method using the same wherein plural posable figures are retained for selective posing and rotation to produce unique, user-designed animation sequences.

BACKGROUND OF THE INVENTION

The present inventor has a demonstrated history of inventing devices that popularize, demystify, and make the art of animation accessible to the general public. Indeed, a plurality of those developments have achieved not only substantial commercial success but also patent protection in the United States and elsewhere. Among those patented developments are the Manually Operated Moveable Display Device disclosed by U.S. Pat. No. 5,901,484 and the Visual Display Device with Continuous Animation taught by U.S. Pat. No. 6,286,873. Furthermore, the present inventor's U.S. Pat. No. 7,151,541 protects a Moveable Animated Display Device, and U.S. Pat. No. 7,331,132 is directed to a Rotatable Animation Device. Still further, the inventor participated in the inventions of U.S. Pat. Nos. 8,233,099 and 8,582,063 for a Temporary Birefringent Color Image Apparatus and Method and for an Optical Toy. Yet further, U.S. Pat. No. 8,373,842 teaches a Praxinoscope Kit and Assembly Method. A Stroboscopic Animation System is disclosed by U.S. Pat. No. 8,482,714. Each of these has usefully advanced the art of display and animation.

Even with these and further developments in the art, it has become clear to the present inventor that there remains a need for a system and method that permits a user to create animation in three-dimensions, and that need is even more apparent with respect to persons with minimal artistic ability. By way of example, the inventor has appreciated that permitting realistic animation in three-dimensions without requiring the artistic ability typically demanded by the known prior art will enable unparalleled creative opportunity with the potential endless creation of new animation sequences.

By way of further background, it has been established since the inventions in the mid-1800's of the zoetrope, the praxinoscope and similar early motion picture devices that a series of drawings, each a little different, printed on a paper strip and arranged around the drum of such a device can create the illusion of realistic human or animal locomotion when the device is spun. The fascination with such devices persists today. Toy versions continue to be manufactured and sold to the curious public. Almost without exception, these toys include a selection of pre-printed paper animation strips for immediate viewing. In addition, they often include unprinted paper strips upon which the user is invited to draw their own animations from scratch. One problem with such toys is that the average consumer lacks the artistic ability to draw their own convincing, sequential animations from scratch. The ability of the user to interact creatively with the toy is thus hobbled. In frustration, most users set aside the blank strips and content themselves with watching the pre-printed animations. The play value and, consequentially, the sales potential for such a toy has typically been limited.

Manufacturers of such toys, including this inventor, have attempted to mitigate this limitation by furnishing faintly-printed outlines on the paper strips upon which the user can color or otherwise augment with markers and crayons. While such outlines permit the user to imprint some of their own personality upon the animation, it does not permit them to alter the animation itself or to create altogether new animation sequences of their own choosing.

With an appreciation of this, the inventor saw the need for an animation toy that would permit the average consumer to experience the joy of endlessly creating his or her own original animated sequences with ease. Moreover, the inventor came to realize that the inclusion of ready-made three-dimensional, repositionable figures in an animation toy would be preferable to blank paper strips because, as the figures would already exist, no artistic skill would be required to create them. To create convincing animations, all the user need would need to do would be to position the figures, such as by having each one posed a little differently from the preceding and subsequent figures.

One knowledgeable in the art will be aware that, since the invention of such toys in the 1800's, it has been known that a series of three-dimensional models, each posed a little differently, may be substituted for printed paper strips to deliver a more dynamic animation effect. In 1870, for example, the French biologist Etienne Jules Marey created a zoetrope containing a series of small, three-dimensional plaster sculptures of a white seagull, with its wings in different positions from pose to pose. When the device was spun, the seagull appeared to flap its wings.

Even today, many such three dimensional animated displays are created by artists. For instance, a popular example touring museums today is a room-sized, strobe-light animated zoetrope featuring the characters sold by the Pixar Company under the TOY STORY registered trademark. Because of the time-consuming effort it takes to create three-dimensional models from scratch and because multiple versions of each figure must be painstakingly sculpted, each a little differently, this delightful display and others like it are often protected from the public by a wall of glass. The museum visitor is invited to look, but not to touch.

Still, the inventor imagined a toy version containing ready-made posable figures that are specifically intended to be posed and reposed by the end user. In so imagining, though, the inventor perceived the issues that would be confronted to permit realistic, flowing animation. Problems demanding solutions included the methods by which the figures would be mounted to the toy itself and the impact on the animation effect such mounting methods might effect. Posable figures alone would not be sufficient to create a convincing illusion of animation; a series of fixed-length posts, for example, would not suffice because they would limit the animated figure's ability to change either their height or their axial orientation, both being essential visual cues to creating the illusion of realistic action.

Through rigorous experimentation and thought, this inventor has concluded that, to create a convincing illusion of lifelike animation with posable figures, the method of mounting the figures to the device is thus as important as the posability of the figures themselves. More particularly, the mounting system itself must be made to be universally positionable to facilitate, among other things, the repositioning of the physical locations and orientations of the figures.

Consider, for example, a simple ten-figure animation of a posable character jumping up and down: The first of the ten figures must be posed in a tight crouch and positioned low to the floor of the device. The successive figures must not only be positioned to have their legs extend more and more, but they must also be positioned higher and higher until, such as by the fifth or six pose at the height of the simulated jump, that particular figure, now elongated, arms up, must appear to be slightly levitated in the air, its toes positioned a distance above the floor of the device. A rigid, fixed length post would make this impossible because the end result would be rather like that of a flapping butterfly glued to an immobile stick; it would not look natural, convincing, or fully alive. Another example would be an animation in which the figure is made to dance, hopping from side to side over a fixed center point. A fixed, rigid post would not permit that. One might further consider a figure that is intended to do a black flip in the air. Not only must the first figure be positioned low to the floor of the device and a subsequent figure positioned far above that floor in mid-flip, but each figure itself must also be able to be tilted or pivoted, one pose to the next, to complete the action convincingly. In other words, for convincing animation, the laws of physics and natural movement must be observed.

From the background above, it will now be apparent that the incorporation of rigid, fixed-length posts or other fixed mounting mechanisms do not permit convincing animation. Indeed, such mounting mechanisms would actually defeat it. The inventor discovered that the real need, in addition to the actual posable figures themselves, is the incorporation of universally-adjustable posts to permit the figures to be tilted, swiveled, rotated, to be raised or lowered, or to change their center of gravity from pose to pose, thereby permitting the user to create a more convincing illusion of realistic motion.

SUMMARY OF THE INVENTION

With his appreciation for the state of the art and the real needs summarized above, the present inventor set forth with the basic object of providing an animation system and a method for using the same that permits even users without substantial artistic ability to create realistic, unique three-dimensional animations.

A more particular object of embodiments of the invention is to provide a three-dimensional animation system with selectively repositionable figures with universally adjustable support thereby permitting realistic posing in accordance with the laws of physics and normal, natural movement.

A more particular object of the invention in certain aspects and manifestations is to provide support for posable figures that can be pivoted, turned about a longitudinal axis, adjusted in support height, such as by being lowered as by being squashed or raised, and moved laterally, such as to move the figure's center of gravity on and off center radially inward and outward and advanced or retracted circumferentially.

A related object of embodiments of the invention is to provide a three-dimensional animation device with a practical, universal mounting system that permits easy repositioning of posable figures in all directions for use even by users with little or no artistic experience.

These and further objects and advantages of embodiments of the invention will become obvious not only to one who reviews the present specification and drawings but also to one who has an opportunity to make use of an embodiment of the animation system disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In one example of such an animation system, a universally positionable support can, for example, comprise a plastically deformable core, such as a bendable metal wire, encased in a resilient material, such as rubber, thereby to form a support post for the posable figure. The posable figure could similarly be formed from a resilient material, such as rubber, with a plastically deformable core. The core could traverse from adjacent to the distal end of the post to the body of the posable figure, such as to between the legs of a posable figure that has arms and legs. More than one support could be provided for a given figure. The support can be long enough to permit the figure's feet, or another part where the figure does not have feet, to be selectively positioned a substantial distance above the surface, such as a platform, of the device. If made long enough, for example, such a bendable post could even permit the figure to be turned partially or completely upside down, even with the figure's arms or other parts outstretched, without touching the platform surface.

The same universally positionable support could be used to tilt or rotate the figure in any direction or to position its center of gravity left, right, forward or back an appreciable distance around the central mounting axis. Further, the figure could be positioned closer to or even flush with the surface of the platform, such as by bending the support post to double it over, effectively collapsing it.

Embodiments of the universally adjustable support need not be founded on rubber encased wire. Other possible embodiments include supports with plural articulated rigid sections, such as plural sections connected by ball joints. Still further, embodiments of the support are contemplated with a series of ball joints connected in series.

The inventor has also found it beneficial to design such a support so that it is removable and replaceable in relation to the platform of the device. This allows the user more access to the posable figures so that each may be positioned more easily and, potentially, with more accuracy before returning it to its place on the platform. As is also disclosed herein, such removability also permits the removal of a figure from a given animation sequence as might be desired to produce an animation effect wherein the resulting animated figure apparently moves laterally through the viewing area.

There are multiple possible methods and structures for rendering a support removable and replaceable relative to the platform, each within the scope of the invention. One example of how to make such a post or other support removable from the platform comprises a platform with a series of apertures disposed along a circle in the platform into which the bottoms of the posts or other supports can be inserted. The depth of insertion of the posts within the platform could be adjustable, such as by a selective disposition of the post within the aperture. Additionally or alternatively, the depth to which the posts or other supports can be inserted can be limited and controlled by stops, such as stops molded into the posts themselves. One may easily imagine other removable mounting methods, such as magnets, clips, mechanical engagements, slots, or putty or other fastening material.

Embodiments of the animation system for providing adjustable support to plural posable figures can be considered to be founded on a rotatable platform with an axis of rotation. A plurality of posable figures are provided for being supported by the platform. When retained by the platform, the posable figures can be disposed along a circumference of a circle concentric with the axis of rotation of the platform. Each of the plurality of posable figures is selectively reconfigurable in shape, and an adjustable support is provided for each posable figure for adjustably supporting the posable figure relative to the platform. An animation mechanism is provided for being retained by the platform to cause a perceived animation of the posable figures during a rotation of the platform.

The adjustable support for each posable figure can permit the posable figure to be turned about a longitudinal axis, pivoted, adjusted in supported height, and moved laterally relative to the platform over a given range of lateral movement. More particularly, the range of lateral movement can permit bi-directional movement of the posable figures along the circumference of the circle along which the posable figures are supported. The range of lateral movement can also permit movement of the retained figures radially inward and outward relative to the axis of rotation of the platform.

As disclosed herein, each adjustable support can be selectively reconfigurable in shape. For instance, each adjustable support could comprise a reconfigurable elongate post with a proximal end for retaining a posable figure, a distal end for being retained by the platform, and a reconfigurable or bendable body portion between the proximal and distal ends of the post. Each elongate post can be formed integrally with the retained posable figure, or it could be fixed or removably coupled thereto.

The posable figures and the elongate post of each adjustable support could be plastically deformable. In one example of the animation system, the elongate post of each adjustable support can have a plastically deformable core, such as a tough, bendable wire, at least partially encased in a flexible body of material. Posable figures could vary widely within the scope of the invention. In certain embodiments, the posable figures can comprise figures, such as humanoid figures, with heads, torsos, and appendages. Each posable figure could have predetermined bending locations in the flexible body of material that encases the plastically deformable core. For instance, where the figures are simulative of living beings, narrowed portions can be disposed in the flexible body of material in the locations of joints in the beings.

The distal ends of the elongate posts could be supported by the platform in any effective manner, including by being fixed thereto or by being removable and replaceable. In embodiments of the animation system, a plurality of apertures can be disposed in the platform along the circumference of the circle for removably and replaceably receiving the distal ends of the elongate posts of the adjustable supports. To enable the elongate posts to be consistently placed within the apertures, a stop can be disposed on the elongate post of each adjustable support spaced a distance from the distal end of the elongate post.

The animation mechanism could vary within the scope of the invention. For example, the animation mechanism could comprise a central hub with a faceted, mirrored surface such that the animation system could operate as a praxinoscope. The animation mechanism alternatively could comprise a drum with a plurality of spaced slots such that the animation system would operate as a zoetrope. The central hub and the slotted drum could be fixed in place or removable. Embodiments of the animation system could further provide first and second animation mechanisms. The first animation mechanism could comprise a removable central hub with a faceted, mirrored surface whereby the animation system can operate as a praxinoscope when the central hub is retained by the platform. The second animation mechanism could comprise a removable drum with a plurality of spaced slots whereby the animation system can operate as a zoetrope when the drum is retained by the platform.

One will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

The posable animation system disclosed herein is subject to varied embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Figure 1:
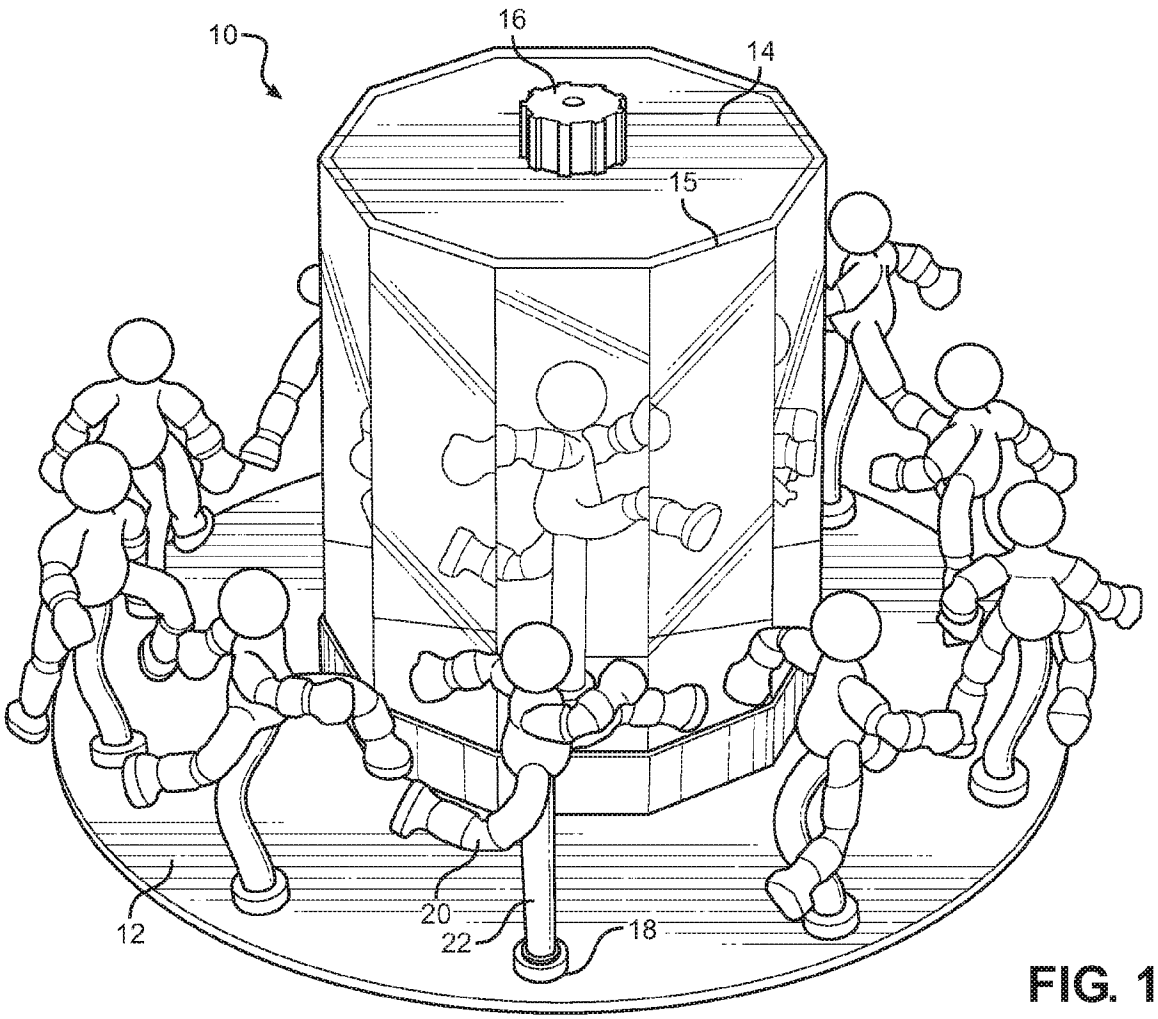
FIG. 1 is a perspective view of a posable animation system according to the invention.
Figure 2:
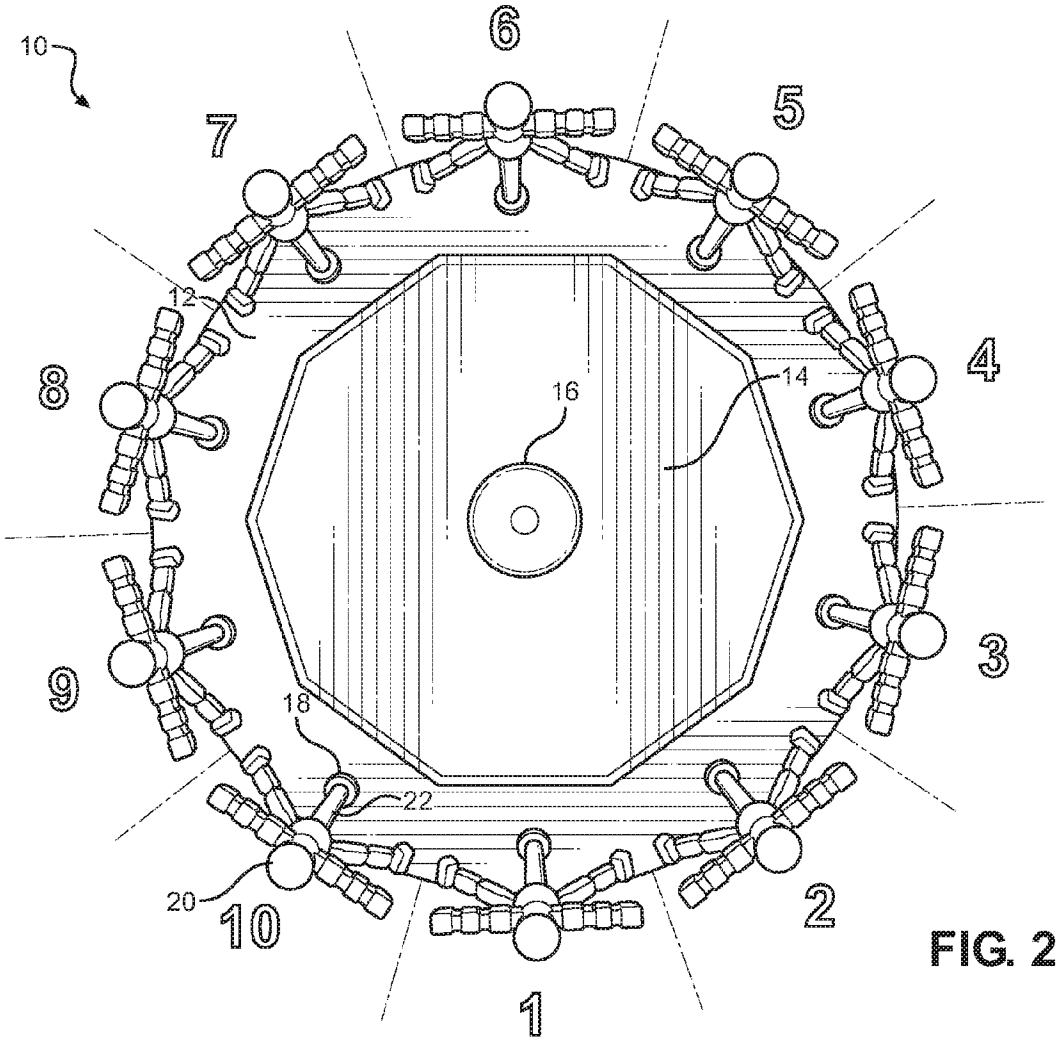
FIG. 2 is an upper perspective view of the posable animation system of FIG. 1.

With this in mind and looking more particularly to the accompanying figures, an embodiment of a posable animation system pursuant to the present invention is indicated generally at 10 in FIGS. 1 and 2. There, the posable animation system 10 has a plurality of selectively posable FIG. 20 retained for rotation with a rotatable structure 12. In this example, ten posable FIG. 20 are retained, but it will be understood that fewer or more FIG. 20 are possible within the scope of the invention. It will be noted, however, that more FIG. 20 are usually better than fewer FIG. 20 since the more FIG. 20 and, accordingly, the more mirrors in the case of the praxinoscope and the more slots in the case of a zoetrope, the clearer the animation effect.

Similarly, it will be understood that the rotatable structure 12 could vary widely within the teachings of the invention. The rotatable structure 12 could be manually rotatable or rotated automatically as by a motor, gearing, and a suitable source of power. In the depicted embodiment, the rotatable structure 12 comprises a round platform 12. The platform 12 can be manually rotated in any effective manner. By way of example and not limitation, the platform 12 could be rotated by a user's gripping or otherwise engaging the edges of the platform 12. Alternatively, the platform 12 could be rotated through a user's gripping a concentrically disposed knob 16, which in this embodiment is disposed atop a central hub 14.

Figure 3:
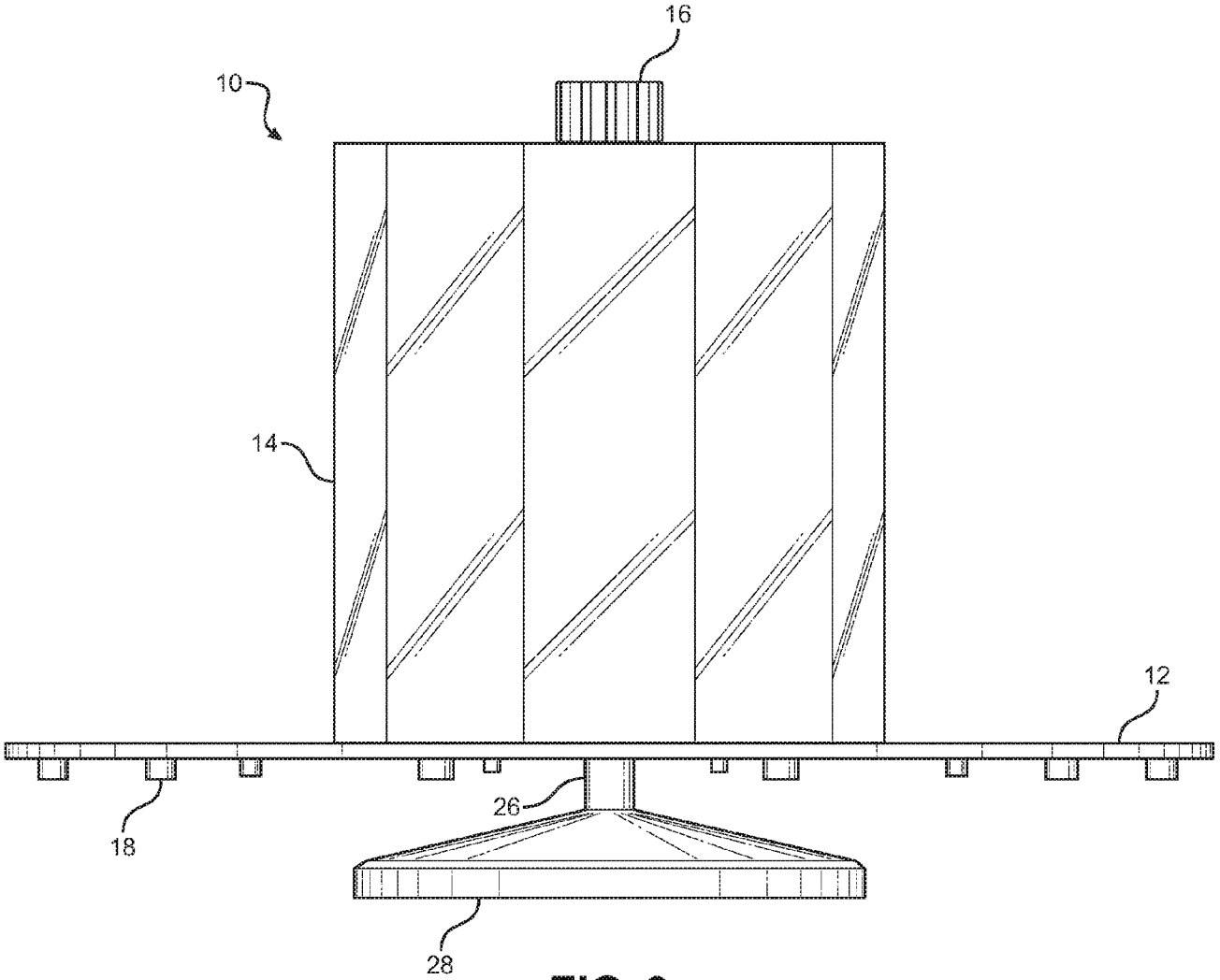
FIG. 3 is a view in front elevation of a posable animation system with the posable figures removed therefrom.

The platform 12 can be rotatably retained in any suitable manner. As seen, for instance, in FIG. 3, the platform 12 could be rotatable on a concentric support post 26 retained by a stand 28. In other practices of the invention, such as where the platform 12 is automatically rotated, the platform 12 could be rotatably supported by a turntable.

As depicted in FIGS. 1 and 2, the posable animation system 10 of the current manifestation of the invention comprises a praxinoscope. As such, the hub 14 comprises a mirrored hub 14 with a plurality of mirrored facets 15. The facets 15 are disposed tangent to a concentric circle of rotation of the hub 14. The posable FIG. 20 can, for example, be arranged along a concentric circle outside the surface of the hub 14 at a distance equal to the distance from the outside of the hub 14 to its rotational center. Based on this mathematical relationship between the posable FIG. 20, the mirrored facets 15 of the hub 14, and the axis of rotation of the platform 12, the virtual images of the posable FIG. 20 reflected by the mirrored facets 15 of the hub 14 during rotation of the platform 12 appear to be standing stationary in space suspended in the center of the hub 14.

The hub 14 can have a number of facets 15 corresponding to the number of posable FIG. 20, and the facets 15 and posable FIG. 20 can be aligned radially on the platform 12. With this, the reflections of the similarly disposed posable FIG. 20 will appear more or less stationary in position as the platform 12 is turned. A person looking in the mirrored facets 15 will thus perceive a series of visual wipes in which the reflection of each stationary posed figure is replaced by the next in continuous, rapid succession, thereby imparting the impression of lifelike movement to what appears to be a single figure thereby producing the illusion of motion As shown and described herein below, however, the method of achieving animation using the poseable FIG. 20 as disclosed herein can be varied. For instance, the system 10 could alternatively be constructed as a zeotrope, or the system could be convertible between praxinoscope or zeotrope embodiments. Still further, the posable FIG. 20 could be animated through stroboscopic illumination or any other method or combination thereof.

The bodies of the posable FIG. 20 are selectively configurable and reconfigurable in a plastically deforming manner. One skilled in the art will understand that the plastic deformation of the FIG. 20 could be carried forth in multiple different ways or combinations thereof. As shown, for instance, in FIGS. 7A and 7B, the posable FIG. 20 shown in the animation system 10 of FIGS. 1 and 2 can comprise flexible bodies, such as bodies of rubber of another polymeric material, formed in the configuration of the appropriate FIG. 20. Here, the FIG. 20 comprise humanoid FIG. 20 with a head 34, a torso 36, arms 38, and legs 40. However, substantially any other animate or inanimate FIG. 20 or combination of FIG. 20 would be possible, including animals, geometric structures, or any other FIG. 20 or combination of FIG. 20.

The flexible bodies of the posable FIG. 20 can be maintained in desired configurations by a plastically deformable, reconfigurable core 44 or other adjustable mechanism. In this embodiment, the reconfigurable core 44 comprises a tough, bendable metal wire that traverses the selectively repositionable components of the FIG. 20. The core 44 can be one continuous member, multiple joined members, plural discontinuous members overlapping or spaced, or any other possible variation. Here, the reconfigurable core 44 traverses through the torso 36, into the head 34, and along the substantial length of the arms 38 and legs 40. Where strands of the core 44 meet, they can be welded or otherwise joined, or they can simply overlap. With such a repositionable core 44, the components of the FIG. 20 can be selectively configured to cause the FIG. 20 to assume infinitely variable positions, whether it be as if the FIG. 20 is running, dancing, jumping, or engaging in some other movement.

Figure 7B:
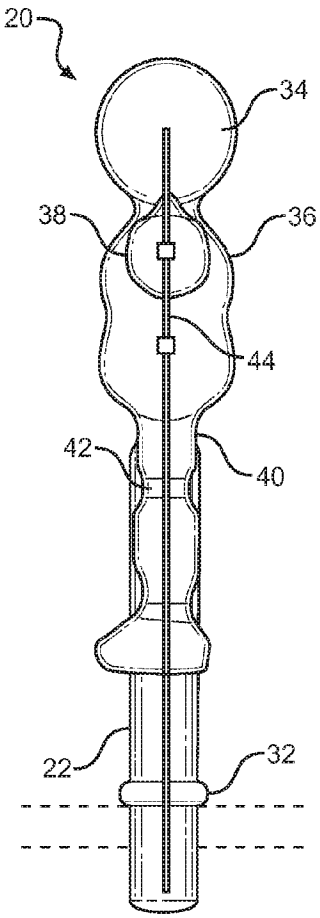
FIG. 7B is a sectioned view in side elevation of the posable figure of FIG. 7A.
Figure 7A:
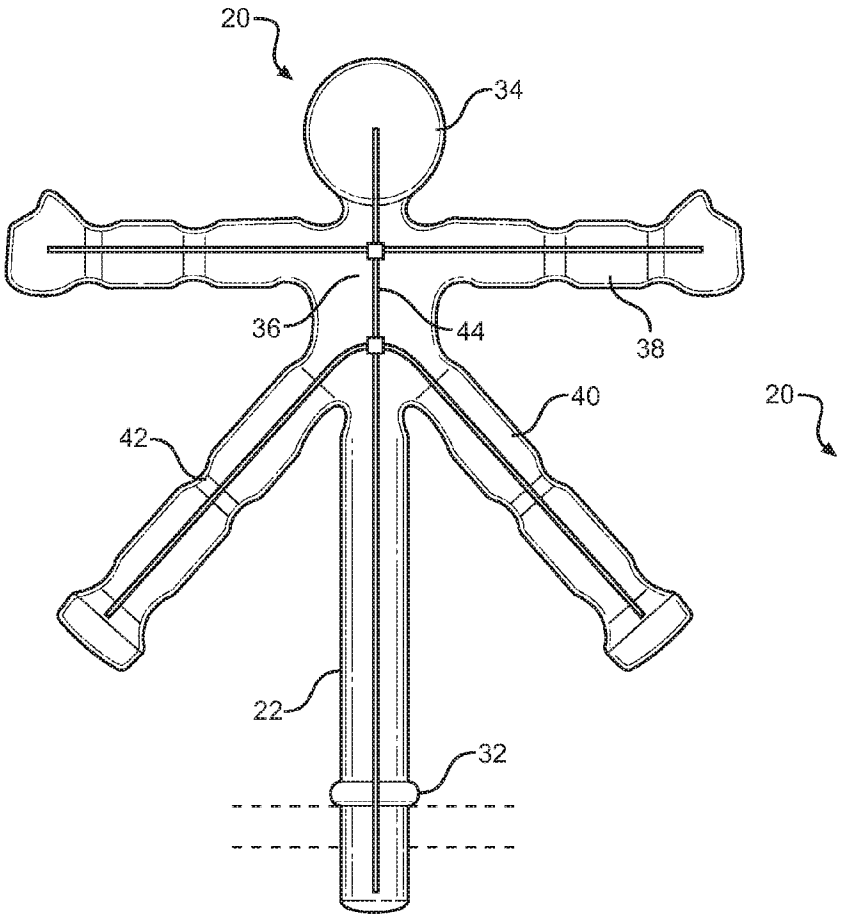
FIG. 7A is a sectioned view in front elevation of a posable figure according to the invention.

The FIG. 20 can be configured to permit or promote primary bending at predetermined locations along the components of the FIG. 20. For instance, the FIG. 20 can include joints or predetermined bending locations. Where the FIG. 20 is simulative of a living being, by way of example, the locations of the joints of the relevant being's body can be formed to permit or promote primary bending by having narrowed portions 42 in the flexible body forming the FIG. 20 along with the core 44. As seen in FIGS. 7A and 7B, for example, the FIG. 20 can have narrowed portions 42 at the shoulders, elbows, wrist, hips, knees, and ankles. With this, more realistic positioning can be simulated.

The FIG. 20 are supported relative to the platform 12 by universally-adjustable supports or posts 22. The supports 22 have distal ends retained by the platform 12, proximal ends that retain the FIG. 20, and repositionable body portions between the proximal and distal ends. The universally-adjustable supports 22 permit adjustment of the position and orientation of the FIG. 20 in all directions and respects. This universal adjustability has been determined by the inventor to be fundamental to achieving realistic three-dimensional animation, animation consistent with natural movements and substantially comporting with the laws of physics. Through pivoting, bending and other adjustment of the universally-adjustable supports 22, the FIG. 20 can be rotated about a longitudinal axis, pivoted in all directions, adjusted in supported height, and moved laterally, such as to move the location and center of gravity of the FIG. 20 in any direction relative to the longitudinal axis.

The inventor has conceived of multiple constructions for the universally-adjustable supports 22, each within the scope of the invention except as it might be expressly limited by the claims. In the embodiment of FIGS. 1, 2, and 6A through 7B, for instance, a single support 22 is provided for each FIG. 20, but it should be understood that embodiments are possible with additional supports 22. The support 22 in this example is configured similarly to the body of the FIG. 20 with a repositionable, plastically deformable core 44 encased within a flexible body of material, such as a flexible polymeric material. The support 22 could have a generally annular cross section. A stop 32, which could also be annular, can be disposed on the support 22 spaced a given distance from the distal end of the support 22. The stop 32 could, for example, comprise an annular protuberating ring disposed on the support 22.

Figure 5:
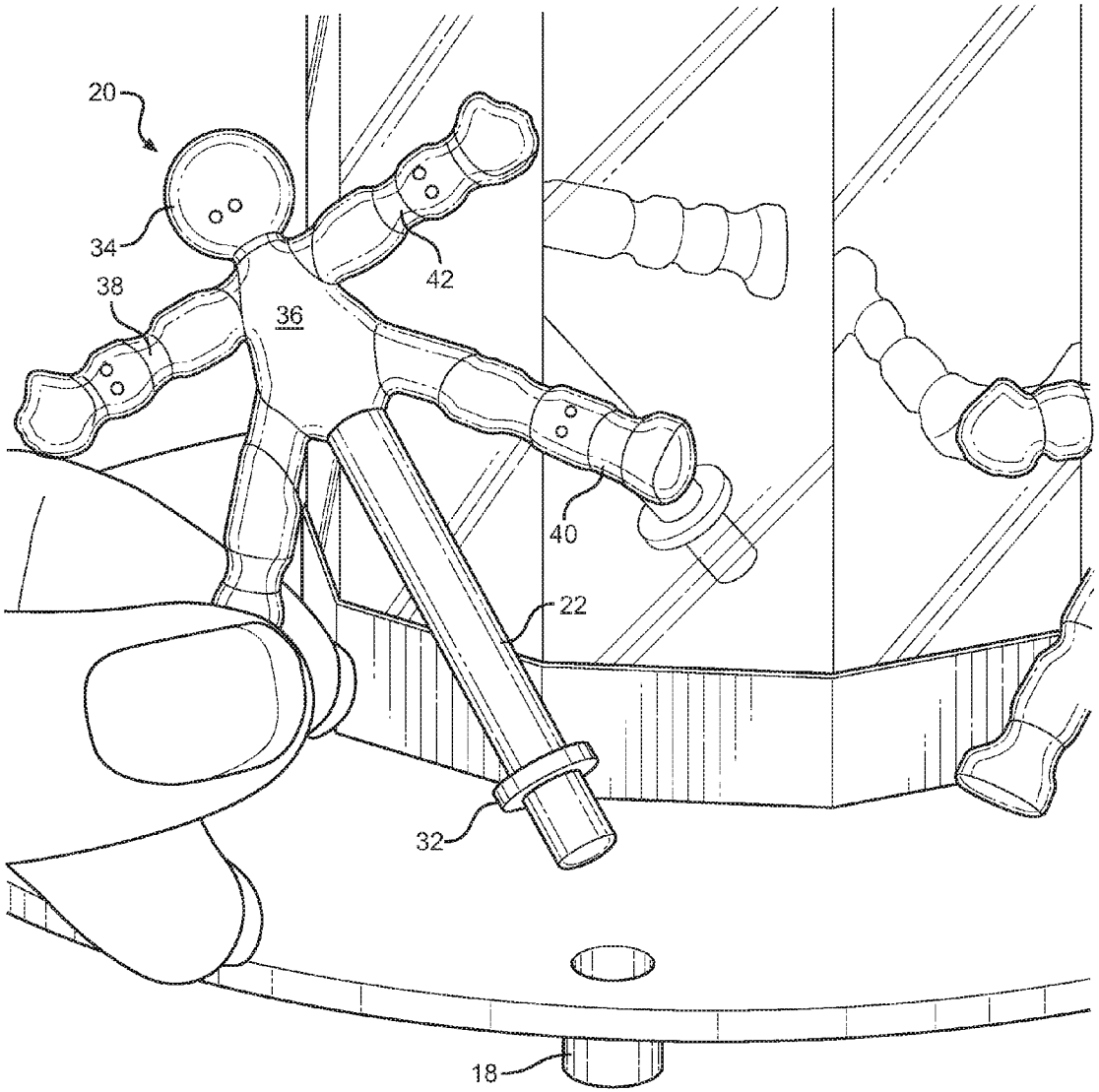
FIG. 5 is a perspective view of a posable figure during insertion into a rotatable platform of a posable animation system as taught herein.
Figure 6B:
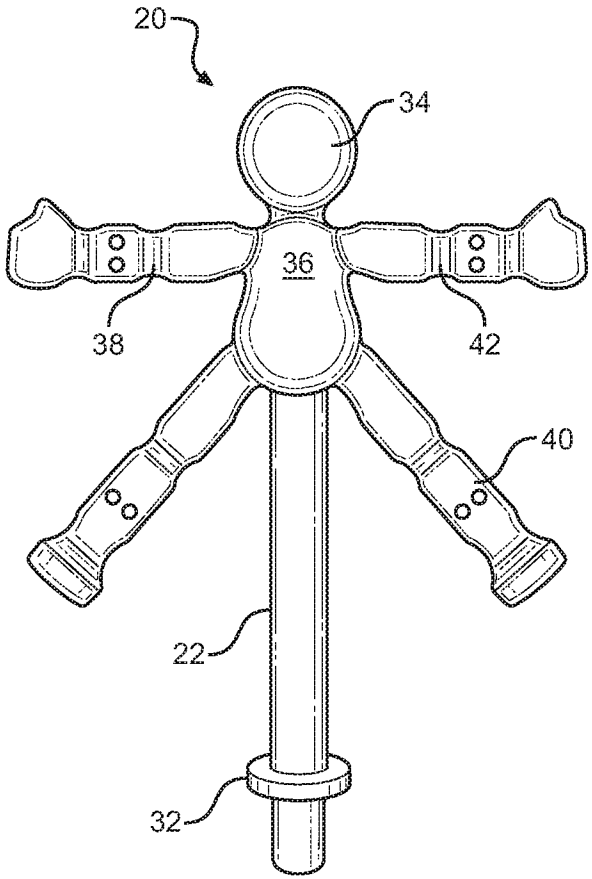
FIG. 6B is a view in rear elevation of the posable figure of FIG. 6A.
Figure 6A:
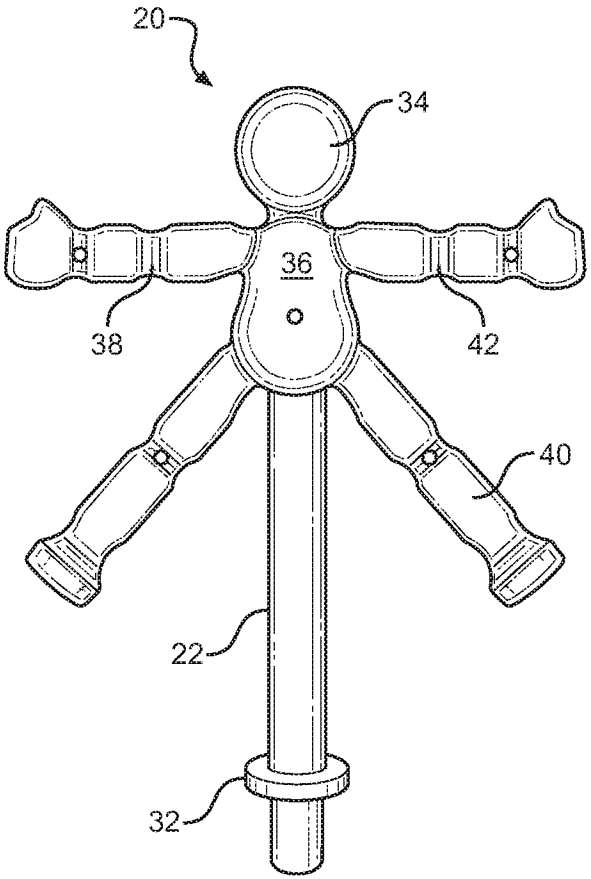
FIG. 6A is a view in front elevation of a posable figure according to the invention.

The platform 12 has a corresponding plurality of apertures 18 evenly spaced therearound along a concentric circle for receiving and retaining the supports 22 and, derivatively, the plurality of FIG. 20. More particularly, the distal ends of each support 22 can be selectively received into a given aperture 18, such as until the stop 32 contacts the surface of the platform 12. As seen perhaps most clearly in FIGS. 3 and 5, each aperture 18 has a boss portion for maintaining received portion of the respective support 22 in alignment with the longitudinal axis concentric with the aperture 18.

Realistic and convincing animation can be achieved through the supports 22, which are adjustable in effective support height, orientation, and lateral position, in shape, and otherwise, and the repositionability of the FIG. 20 themselves. The FIG. 20 can, for instance, be positioned in sequential steps of animation, including by adjusting the positions of the components forming the FIG. 20 themselves and by adjusting the orientation, height, circumferential positioning, radial positioning, and other positioning of the centers of gravity of the FIG. 20 through the supports 22. By way of example and not limitation, the FIG. 20 can be tilted in any direction, even upside down, advanced along the circumference of the circle along which the FIG. 20 are retained, and moved radially inward and outward relative to the axis of rotation of the platform 12 over a given range of movement.

Realistic, natural movement can be simulated, and that realistic movement can be caused to comport with the movements dictated by the laws of physics. Among the innumerable possibilities for realistic, three-dimensional movement are those shown in FIG. 15 where each sequential position of the movement is depicted in a sequential frame. For instance, a FIG. 20 that is configured to appear to be running or sprinting can be leaned forward. A FIG. 20 jumping up and down can be crouched low to the ground represented by the surface of the platform 12 and then positioned in the air with the feet of the FIG. 20 spaced from the hypothetical ground surface. The center of gravity of the FIG. 20 can be shifted rhythmically to the right and left of center as in a side-to-side dance movement. The center of gravity of the FIG. 20 could also be shifted to give a realistic impression of the forces and movements involved in initiating, delivering, and recoiling from a kickboxing kick as the kickboxer hunches down and rears back and then rises and launches forward before recoiling to his or her next ready position. Indeed, the FIG. 20 can even be positioned horizontally, such as in simulation of swimming.

Figure 15:
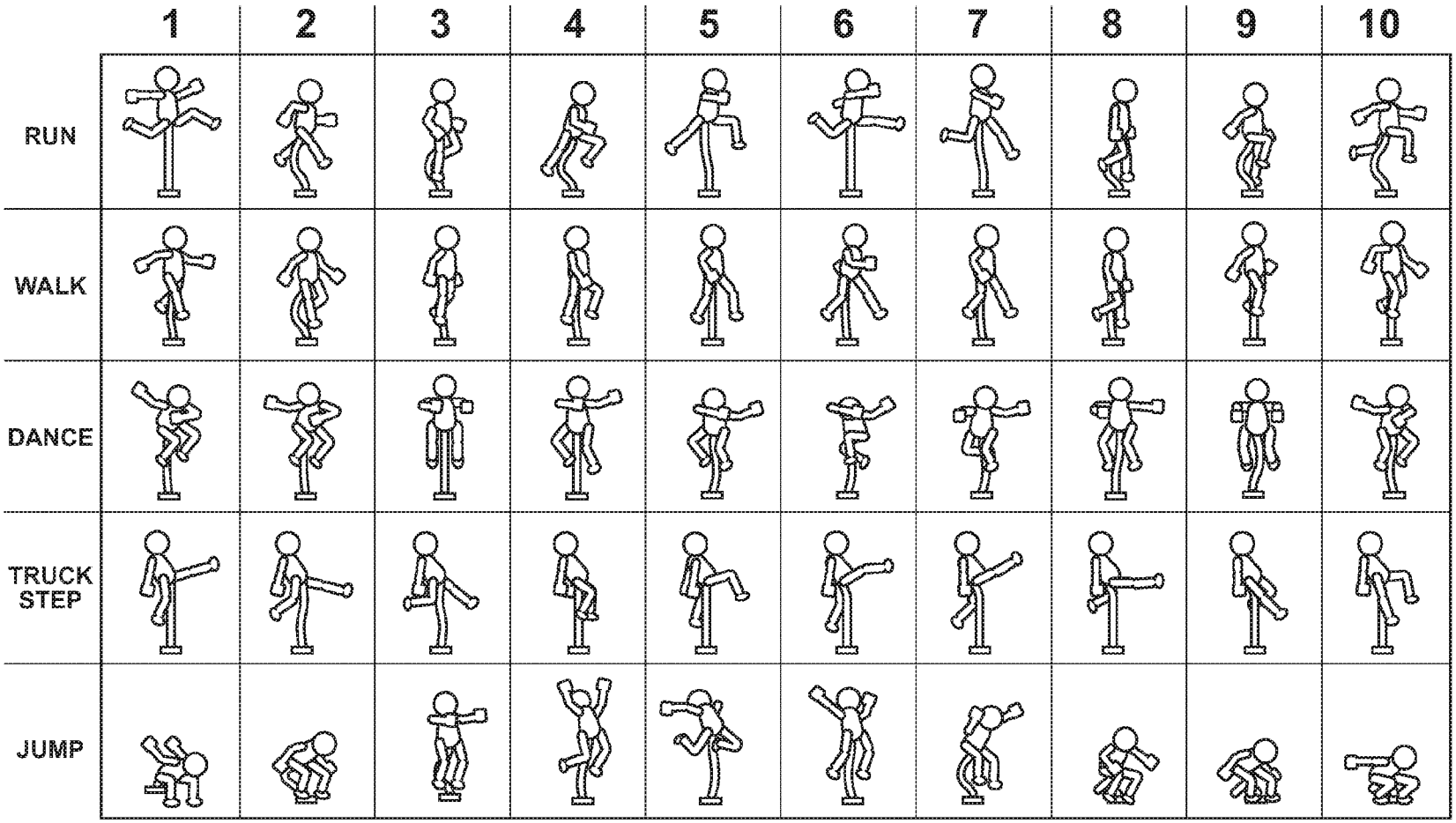
FIG. 15 provides views in front elevation of each of a complete series of poses for a plurality of different simulated figure movements.
Figure 15:
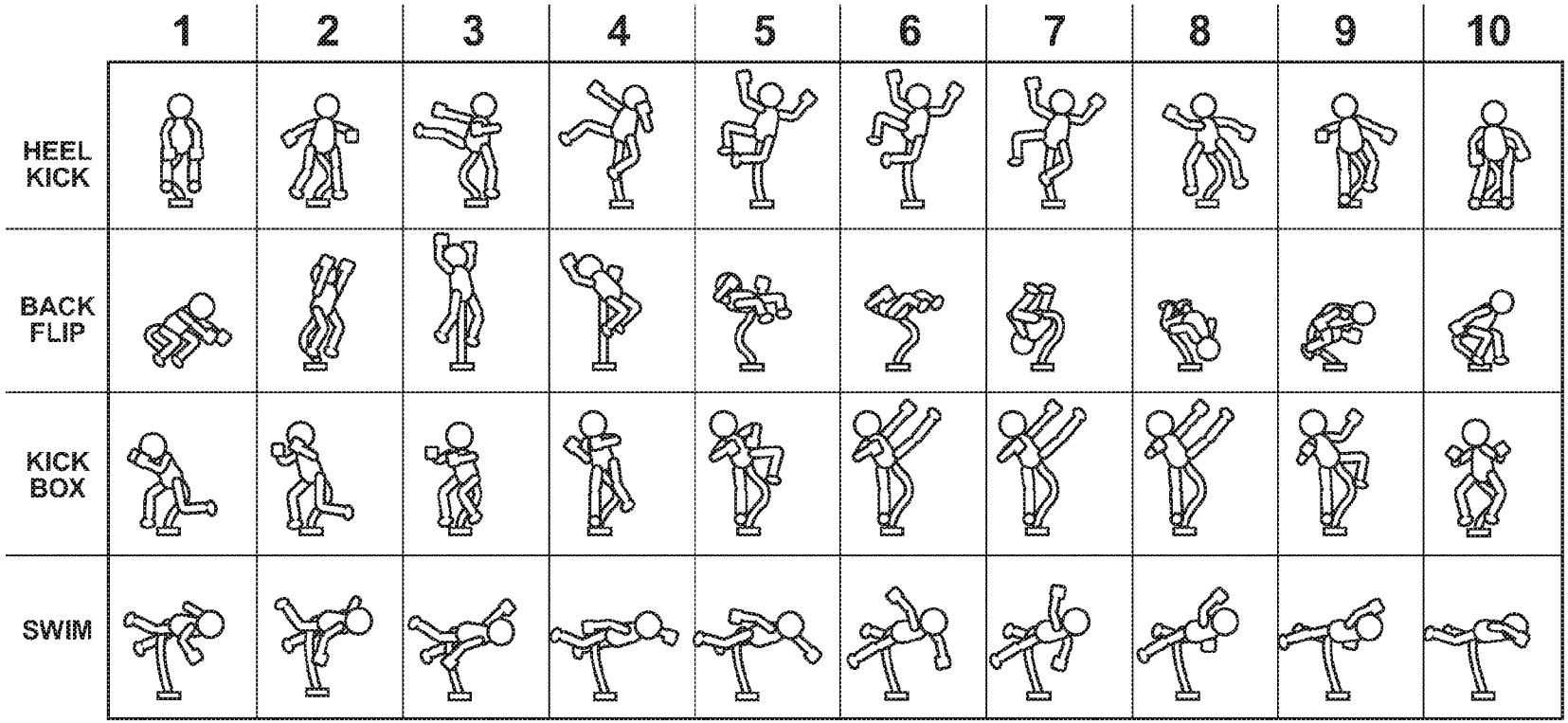

Complex movements, such as the backflip, are perhaps most illustrative of the unique advantages that can be achieved as a result of the universal posability of the FIG. 20 with universally-adjustable supports 22. There, as is illustrated in FIG. 15, the FIG. 20 can begin in a crouched position with the support 22 nearly doubled over upon itself and his or her hands and upper body reaching forward. Then, potentially in two frames, the FIG. 20 can jump to have its arms raised high, its body nearly straight but moving forward, and the support 22 straightened to raise the entire FIG. 20 high above the platform in an athletic leap. By further manipulation of the FIG. 20 and the support 22, the FIG. 20 can then ball up and pivot backward until the feet of the FIG. 20 pass over the head of the FIG. 20 as gravity apparently pulls the FIG. 20 to the surface of the platform 12 as simulated with a progressive bending of the support 22. Finally, an approximately 360-degree rotation is performed as the FIG. 20 comes down to a crouched position with the feet of the FIG. 20 planting on or near the simulated support surface presented by the platform 12. Throughout, the height and center of gravity of the FIG. 20 are capable of being manipulated to provide true realism of movement. While each change in configuration is illustrative of what is possible pursuant to the present invention, one may look particularly to the changes between poses 7 and 8 of the backflip. There, the body of the FIG. 20 retains its relative position in space while the support 22 is moved completely from the back side of the body to the front to permit realistic movement.

Figure 8B:
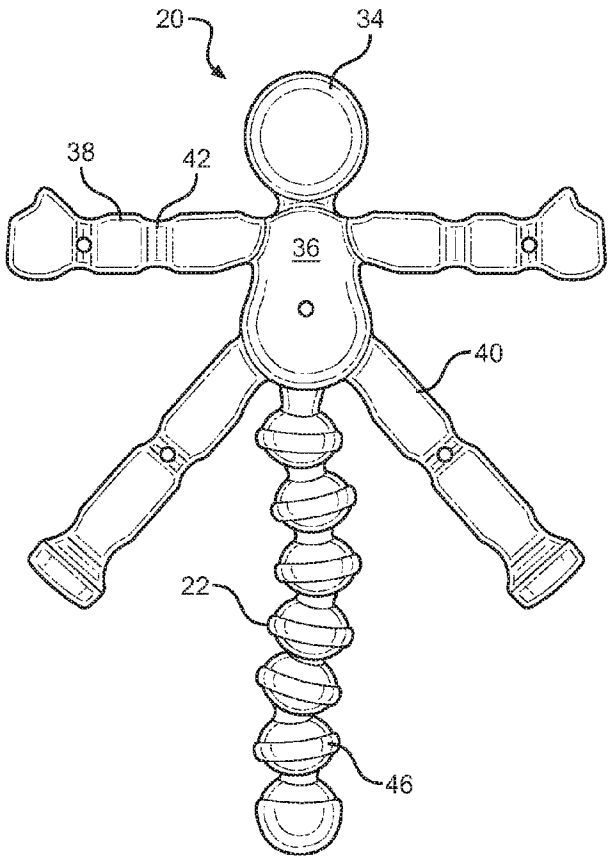
FIG. 8B is a view in front elevation of an alternative posable figure.
Figure 8A:
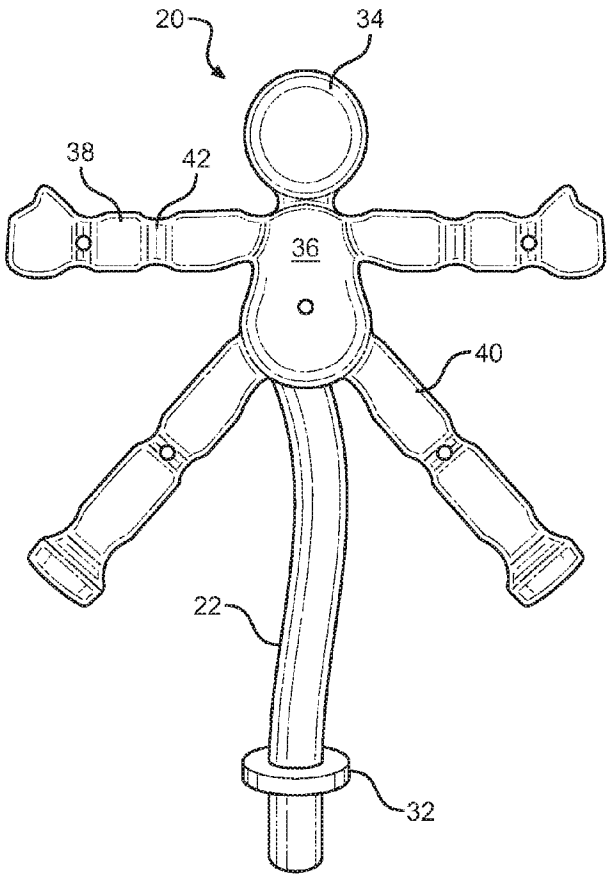
FIG. 8A is a view in front elevation of a posable figure according to the invention.
Figure 9:
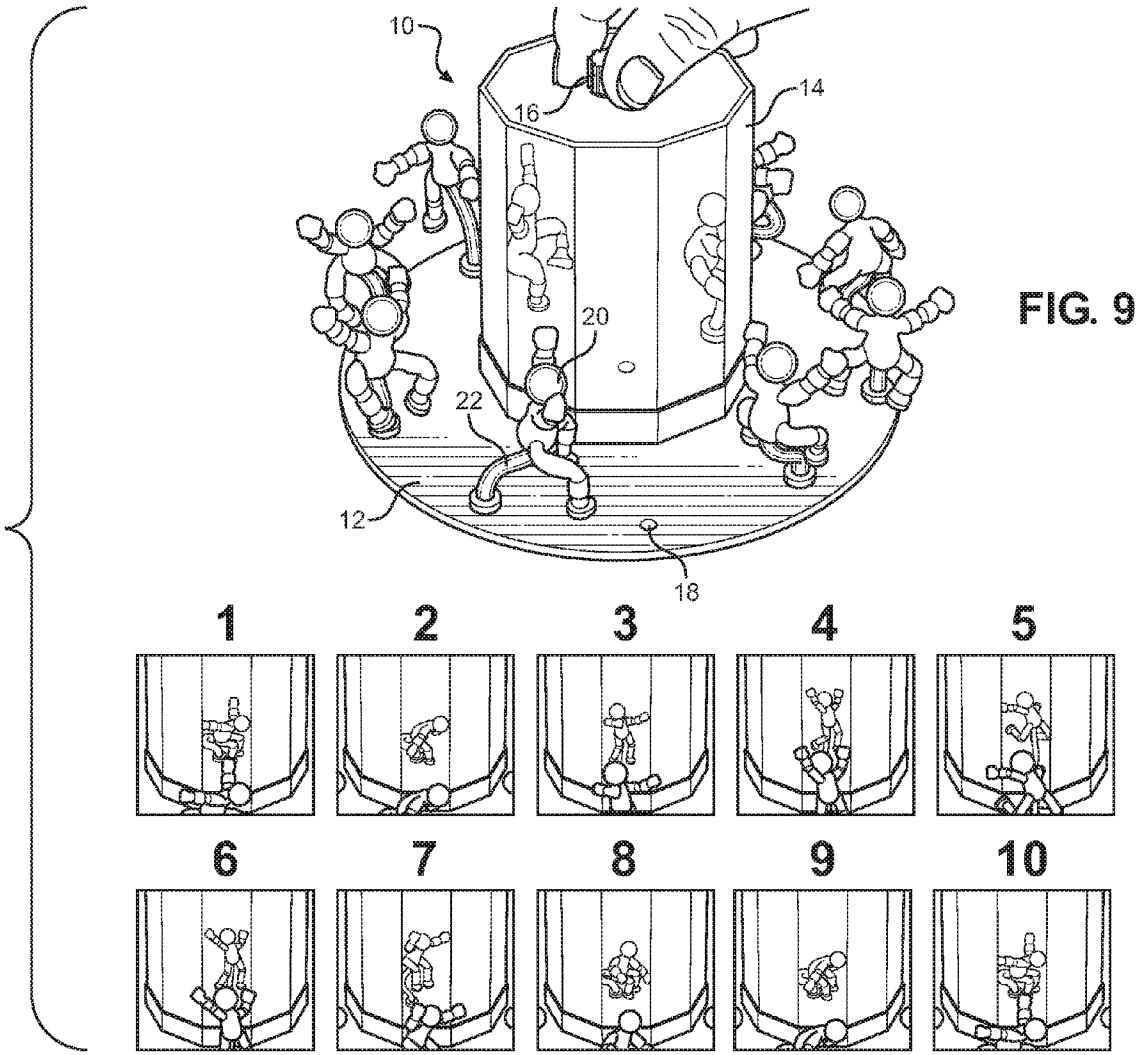
FIG. 9 is a perspective view of steps in one method of using a posable animation system according to the invention.
Figure 14:
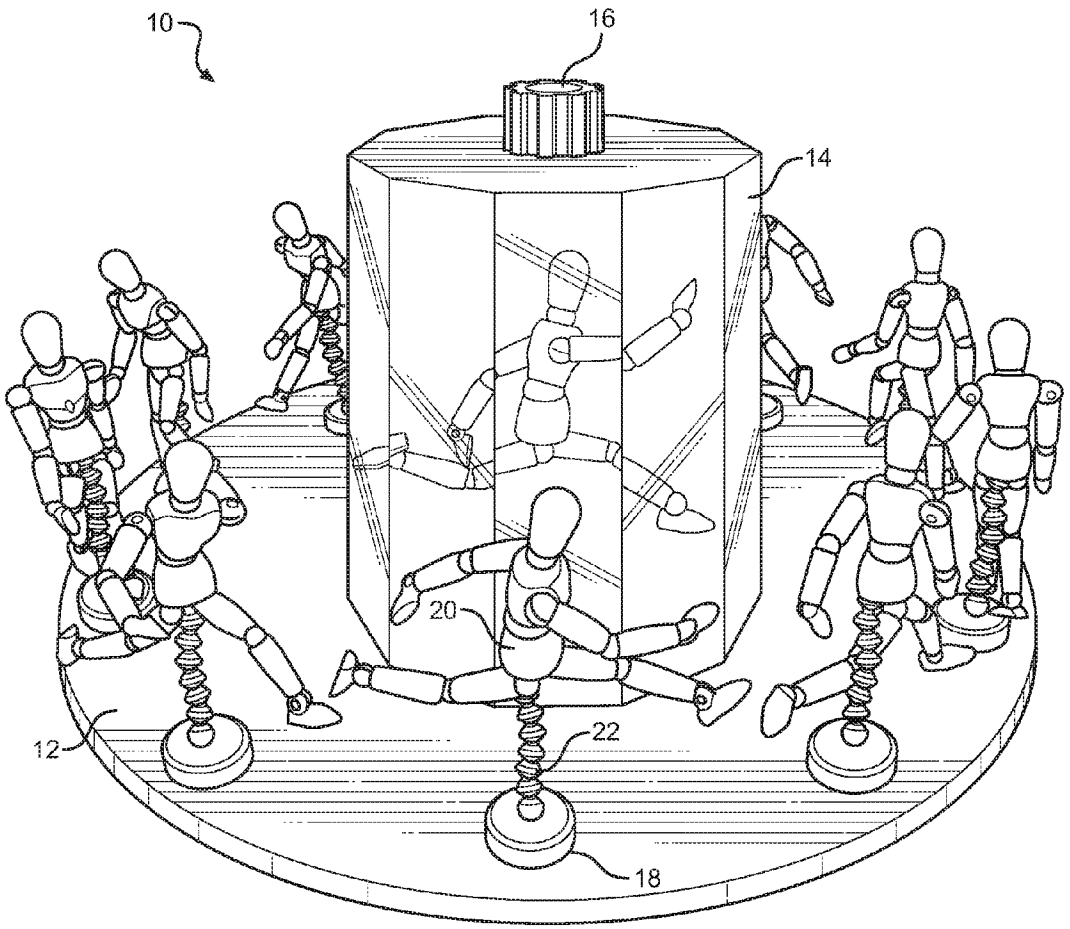
FIG. 14 is a perspective view of an alternative posable animation system.

Other manifestations of the adjustable supports 22 are possible and within the scope of the invention except as it might be expressly limited by the claims. Alternative embodiments of the supports 22 could, for instance, comprise telescoping posts or posts longitudinally slidable relative to the platform 12, potentially with ball and socket swivel joints. The posable FIG. 20 could likewise have joints formed by ball and socket connections as with a moveable mannequin as shown, for instance, in the embodiment of the animation system 10 shown in FIG. 14. As is further illustrated in FIG. 8B, the adjustable supports 22 could be formed to comprise or include a plurality of ball joints connected in series, which would again permit universal adjustability.

Figure 4:
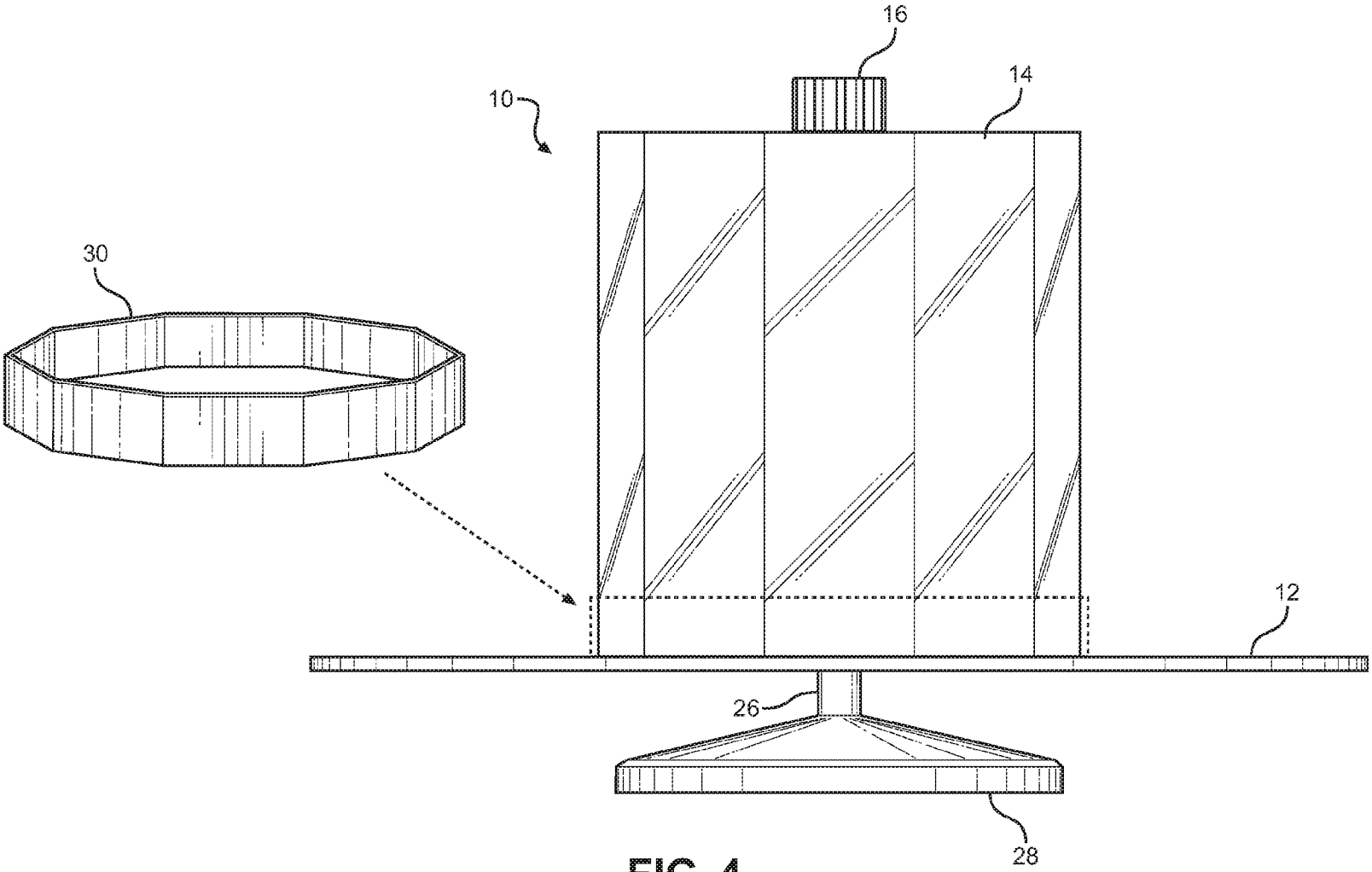
FIG. 4 is a view in front elevation of an alternative posable animation system with the posable figures removed therefrom.
Figure 11:
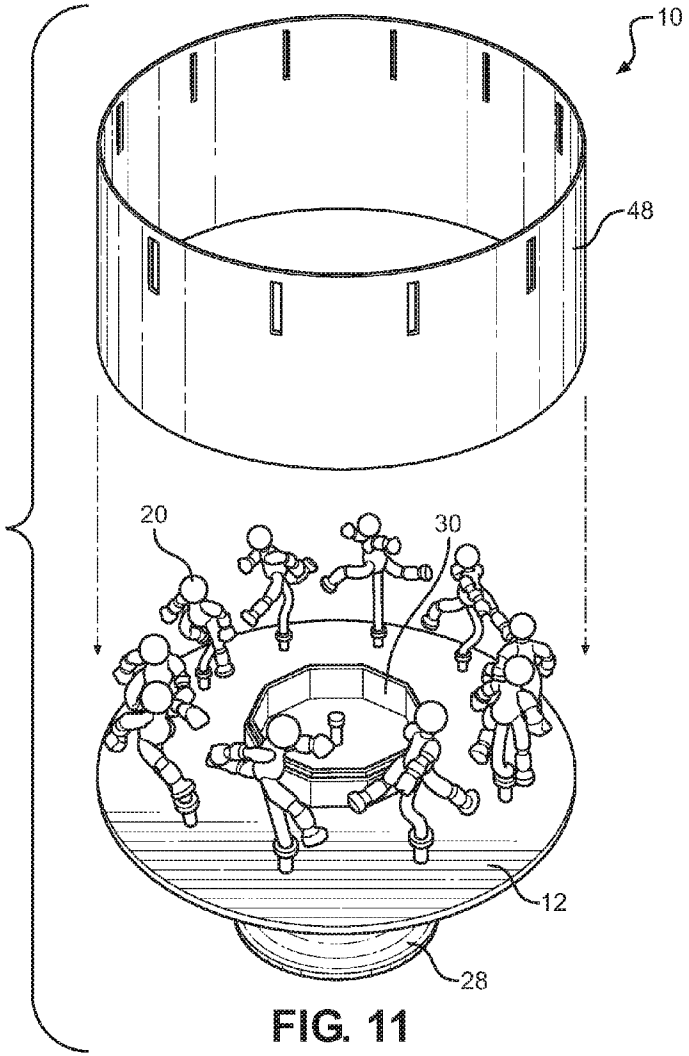
FIG. 11 is a perspective view of the modular posable animation system with a removable animation cylinder.
Figure 10:
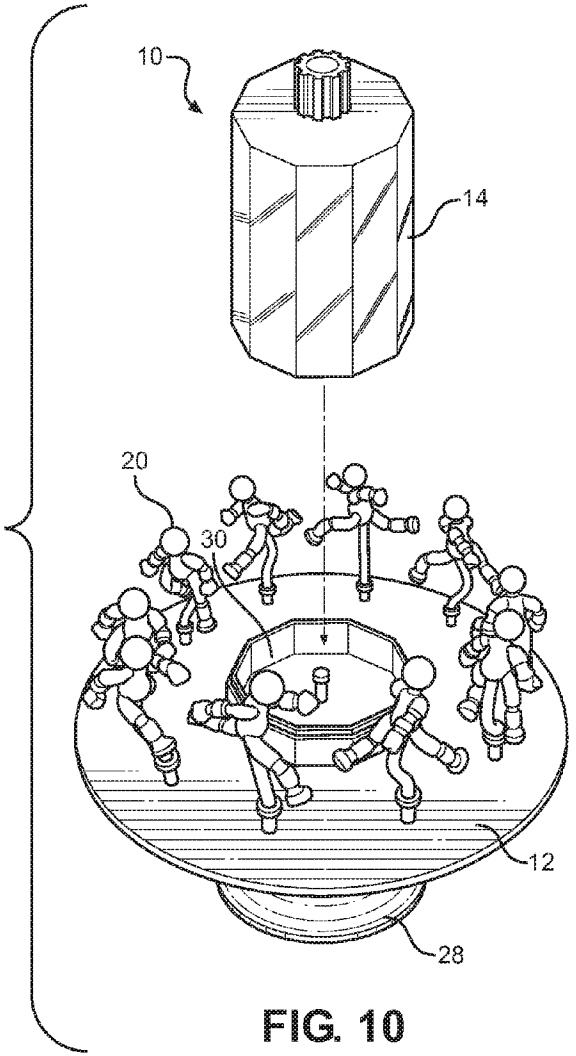
FIG. 10 is a perspective view of a modular posable animation system according to the invention with a removable central hub.
Figure 12:
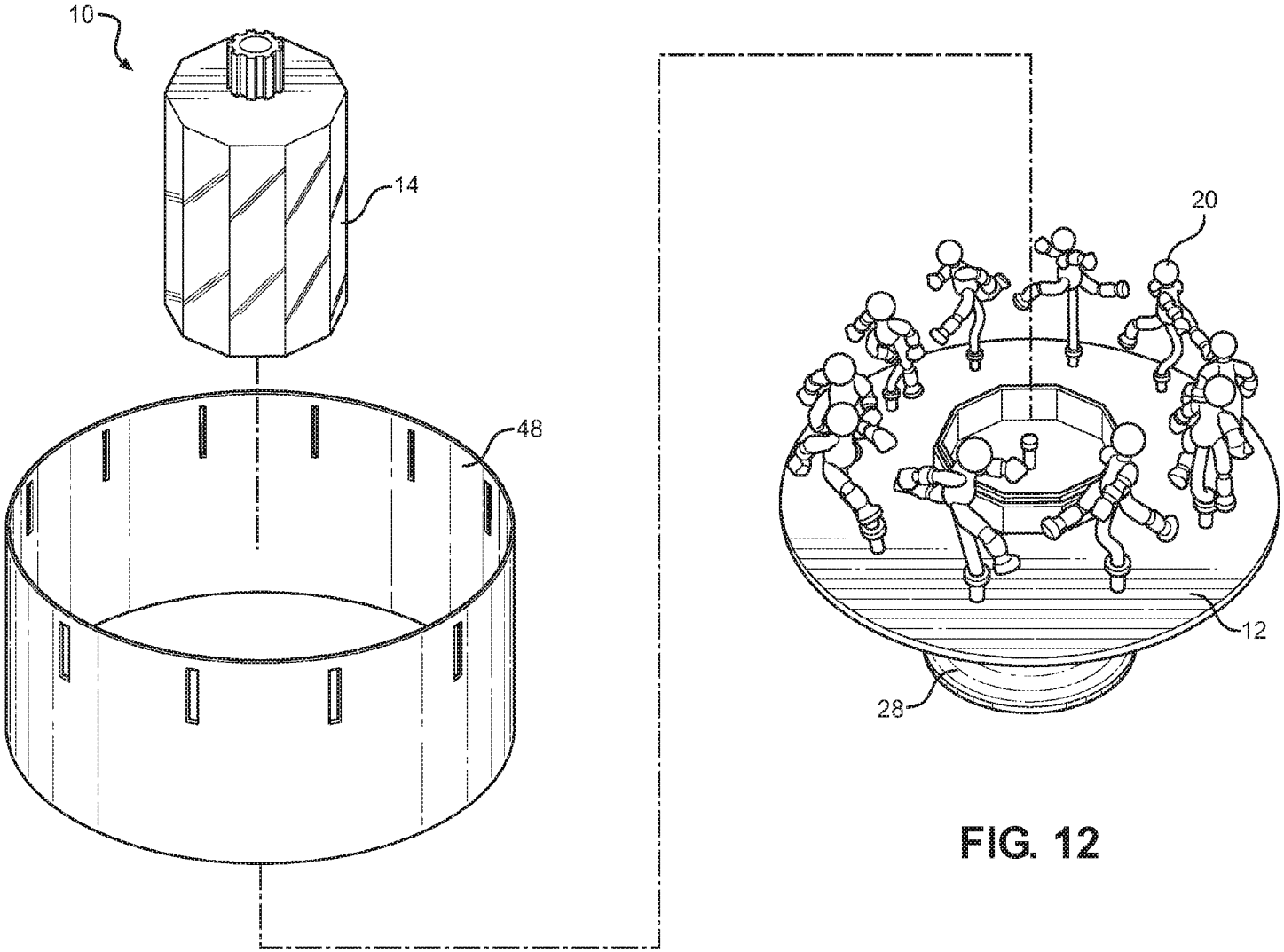
FIG. 12 is a perspective view of a further modular posable animation system with a removable animation cylinder and a removable central hub.
Figure 13:
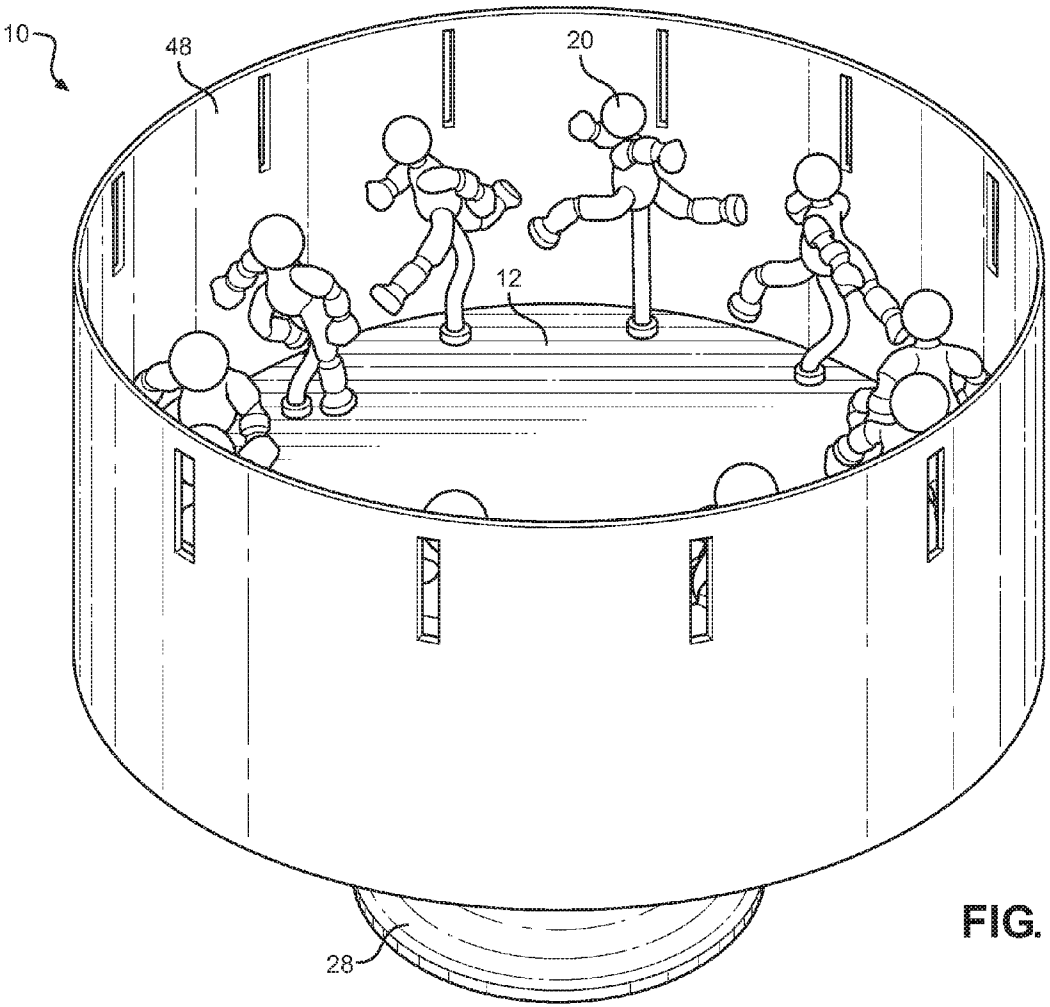
FIG. 13 is a perspective view of the modular posable animation system of FIG. 12 with the animation cylinder in place.

As seen, for example, in FIG. 4, embodiments of the animation system 10 are contemplated wherein the central hub 14 is supported by a faceted ring 30 that can be fixed or removably retained concentrically on the platform 12. The central hub 14 can be selectively removed and replaced as shown in FIGS. 10 and 12. Moreover, a peripheral drum wall 48 with evenly spaced slots could be removably and replaceably received relative to the platform 12 as seen in FIGS. 11 and 12. With this, the animation system 10 can be readily converted between praxinoscope and zoetrope forms at the discretion of the user. The removability of the central hub 14 and, additionally or alternatively, the drum wall 48, also can be exploited to permit easier access to the posable FIG. 20.

In a further application of the invention disclosed herein, the universal adjustability of the FIG. 20 of the system 10 could be exploited to achieve what can be referred to as a travelling figure technique. There, one FIG. 20 can be removed, and the remaining FIG. 20 can be rearranged to be evenly spaced around the platform 12. With the FIG. 20 so disposed, the platform 12 can be rotated thereby to create the illusion that the animated FIG. 20 is travelling, for instance, left to right through the field of animation in the mirrored facets 15 or through the spaced slots in the drum wall 48. Such an animation technique could simulate, for instance, one FIG. 20 chasing after another, and another, and another.

In one illustrative example, the animation system 10 can have ten mirror facets 15 and ten corresponding FIG. 20, each spaced evenly around the platform 12 approximately 36 degrees apart. With all ten FIG. 20 in place, the resulting animation effect will give the appearance that the FIG. 20 is running in place. By removing one of the FIG. 20 and using the adjustable posts 22 to respace the remaining nine FIG. 20 evenly around the platform approximately 40 degrees apart, the animation effect, when the platform 12 is spun clockwise, will be simulative of the animated FIG. 20 running and physically travelling in a left to right direction. The FIG. 20 will appear to enter the viewing area from the left, run through the center of the viewing area, and exit to the right of the mirror viewing area. This sequence will occur once every revolution of the platform 12 thereby resulting in the impression of numerous FIG. 20, one running after the other.

With certain details and embodiments of the present invention for a three-dimensional animation system 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. An animation system with adjustable support of posable figures, the animation system comprising:

a rotatable platform with an axis of rotation;

a plurality of posable figures for being supported by the platform along a circumference of a circle wherein each of the plurality of posable figures is selectively reconfigurable in shape;

an adjustable support for each posable figure for adjustably supporting the posable figure relative to the platform; and an animation mechanism for being retained by the platform to cause a perceived animation of the posable figures during a rotation of the rotatable platform;

wherein the adjustable support for each posable figure permits the posable figure to be turned about a longitudinal axis, pivoted, adjusted in supported height, and moved laterally relative to the platform over a given range of lateral movement.

2. The animation system of claim 1 wherein the range of lateral movement permits bi-directional movement along the circumference of the circle along which the posable figures are supported and movement radially inward and outward relative to the axis of rotation of the platform.

3. The animation system of claim 2 wherein each adjustable support is selectively reconfigurable in shape.

4. The animation system of claim 1 wherein the animation mechanism comprises a central hub with a faceted, mirrored surface whereby the animation system is operable as a praxinoscope.

5. The animation system of claim 4 wherein the central hub is removable relative to the platform.

6. An animation system with adjustable support of posable figures, the animation system comprising:

a rotatable platform with an axis of rotation;

a plurality of posable figures for being supported by the platform along a circumference of a circle wherein each of the plurality of posable figures is selectively reconfigurable in shape;

an adjustable support for each posable figure for adjustably supporting the posable figure relative to the platform; and an animation mechanism for being retained by the platform to cause a perceived animation of the posable figures during a rotation of the rotatable platform;

wherein each adjustable support comprises an elongate post that is reconfigurable in shape with a proximal end for retaining a posable figure, a distal end for being retained by the platform, and a reconfigurable body portion between the proximal and distal ends of the post.

7. The animation system of claim 6 wherein the elongate post of each adjustable support is plastically deformable.

8. The animation system of claim 7 wherein each posable figure is plastically deformable.

9. The animation system of claim 7 wherein the elongate post of each adjustable support comprises a plastically deformable core at least partially encased in a flexible body of material.

10. The animation system of claim 9 wherein the plastically deformable core comprises a bendable wire.

11. The animation system of claim 6 wherein each posable figure comprises a figure with a head, a torso, and appendages.

12. The animation system of claim 6 further comprising a plurality of apertures in the platform along the circumference of the circle for receiving the distal ends of the elongate posts of the adjustable supports.

13. The animation system of claim 12 further comprising a stop disposed on the elongate post of each adjustable support spaced a distance from the distal end of the elongate post.

14. The animation system of claim 6 wherein each posable figure comprises a figure with a head, a torso, and appendages and wherein each posable figure has a plastically deformable core at least partially encased in a flexible body of material.

15. The animation system of claim 14 wherein each posable figure has predetermined bending locations in the flexible body of material that encases the plastically deformable core.

16. An animation system with adjustable support of posable figures, the animation system comprising:

a rotatable platform with an axis of rotation;

a plurality of posable figures for being supported by the platform along a circumference of a circle wherein each of the plurality of posable figures is selectively reconfigurable in shape;

an adjustable support for each posable figure for adjustably supporting the posable figure relative to the platform; and an animation mechanism for being retained by the platform to cause a perceived animation of the posable figures during a rotation of the rotatable platform;

wherein the animation mechanism comprises a drum with a plurality of spaced slots whereby the animation system is operable as a zoetrope.

17. An animation system with adjustable support of posable figures, the animation system comprising:

a rotatable platform with an axis of rotation;

a plurality of posable figures for being supported by the platform along a circumference of a circle wherein each of the plurality of posable figures is selectively reconfigurable in shape;

an adjustable support for each posable figure for adjustably supporting the posable figure relative to the platform; and an animation mechanism for being retained by the platform to cause a perceived animation of the posable figures during a rotation of the rotatable platform;

wherein the system has first and second animation mechanisms wherein the first animation mechanism comprises a removable central hub with a faceted, mirrored surface whereby the animation system can operate as a praxinoscope when the central hub is retained by the platform and wherein the second animation mechanism comprises a removable drum with a plurality of spaced slots whereby the animation system can operate as a zoetrope when the drum is retained by the platform.

18. An animation system with adjustable support of posable figures, the animation system comprising:

a rotatable platform with an axis of rotation;

a plurality of plastically deformable, posable figures for being supported by the platform along a circumference of a circle wherein each of the plurality of posable figures is selectively reconfigurable;

an elongate post for each posable figure for adjustably supporting the posable figure relative to the platform, wherein each elongate post is deformable and selectively reconfigurable in shape, wherein each elongate post has a proximal end for retaining a posable figure, a distal end for being retained by the platform, and a reconfigurable body portion between the proximal and distal ends of the elongate post, wherein the elongate post for each posable figure permits the posable figure to be turned about a longitudinal axis, pivoted, adjusted in supported height, and moved laterally relative to the platform over a given range of lateral movement that includes bi-directional movement along the circumference of the circle along which the posable figures are supported and movement radially inward and outward relative to the axis of rotation of the platform; and an animation mechanism for being retained by the platform to cause a perceived animation of the posable figures during a rotation of the rotatable platform.

19. The animation system of claim 18 wherein each elongate post comprises a plastically deformable core at least partially encased in a flexible body of material.

20. The animation system of claim 18 wherein each posable figure comprises a figure with a head, a torso, and appendages.

21. The animation system of claim 18 further comprising a plurality of apertures in the platform along the circumference of the circle for receiving the distal ends of the elongate posts.

22. The animation system of claim 18 wherein the animation mechanism comprises a central hub with a faceted, mirrored surface whereby the animation system is operable as a praxinoscope.

* * * * *